US012487058B2

(12) United States Patent
Lee et al.

(10) Patent No.: US 12,487,058 B2
(45) Date of Patent: Dec. 2, 2025

(54) FIREARM ACCESSORIES ATTACHMENT

(71) Applicant: Strike IP, LLC, Las Vegas, NV (US)

(72) Inventors: Shanyao Lee, Las Vegas, NV (US); Hung-Ju Lee, Las Vegas, NV (US)

(73) Assignee: Strike IP, LLC, Las Vegas, NV (US)

( * ) Notice: Subject to any disclaimer, the term of this patent is extended or adjusted under 35 U.S.C. 154(b) by 0 days.

(21) Appl. No.: 18/977,751

(22) Filed: Dec. 11, 2024

(65) Prior Publication Data

US 2025/0207893 A1 Jun. 26, 2025

Related U.S. Application Data

(60) Provisional application No. 63/612,504, filed on Dec. 20, 2023.

(51) Int. Cl.
*F41G 11/00* (2006.01)

(52) U.S. Cl.
CPC ..... *F41G 11/003* (2013.01)

(58) Field of Classification Search
CPC ..... F41C 27/00; F41G 11/003
See application file for complete search history.

(56) References Cited

U.S. PATENT DOCUMENTS

2018/0216911 A1* 8/2018 Jen ..... F41G 11/003
2021/0088310 A1* 3/2021 Planck ..... F41G 11/003

* cited by examiner

*Primary Examiner* — J. Woodrow Eldred
(74) *Attorney, Agent, or Firm* — Andy M. Han; Han IP PLLC

(57) ABSTRACT

An apparatus implementable on a firearm includes an accessories attachment device. The accessories attachment device is configured to attach to the firearm. The accessories attachment device includes physical features that are configured to accommodate mounting of accessories capable of mounting by a first design and a second design different than the first design onto the accessories attachment device.

12 Claims, 5 Drawing Sheets

FIREARM ACCESSORIES ATTACHMENT

CROSS-REFERENCE TO RELATED PATENT APPLICATION(S)

The present disclosure is part of a non-provisional application claiming the priority benefit of U.S. Patent Application 63/612,504, filed 20 Dec. 2023, the content of which being incorporated by reference in its entirety.

TECHNICAL FIELD

The present disclosure is generally related to firearm accessories and, more particularly, to a firearm accessories attachment.

BACKGROUND

Unless otherwise indicated herein, approaches described in this section are not prior art to the claims listed below and are not admitted as prior art by inclusion in this section.

At the present time, there are multiple mainstream standards with respect to firearm accessories attachment. For instance, the Picatinny design (also known as MIL-STD-1913 and/or NATO standard STANAG 2324) is a popular and strong design. However, the design tends to be bulky for the sake of maintaining structure strength. Moreover, the design tends to require lots of manufacturing machining, which renders the design relatively expensive and time-consuming in terms of production. Another popular design, M-LOK (or Modular Lock) design, tends to have a lighter weight and tends to be relatively easier to manufacture compared to the Picatinny design. One key feature of the M-LOK design is its slots and specific dimensions intended to accept accessories attachment. However, the thinner and lighter structure of the M-LOK design tends to render an M-LOK attachment unstable and failing to attach to a firearm.

Therefore, there is a need for a solution of a firearm accessories attachment.

SUMMARY

The following summary is illustrative only and is not intended to be limiting in any way. That is, the following summary is provided to introduce concepts, highlights, benefits and advantages of the novel and non-obvious techniques described herein. Select implementations are further described below in the detailed description. Thus, the following summary is not intended to identify essential features of the claimed subject matter, nor is it intended for use in determining the scope of the claimed subject matter.

In view of the aforementioned issues, an objective of the present disclosure is to propose innovative designs of a firearm accessories attachment. It is believed that the proposed designs can avoid or otherwise minimize aforementioned issue associated with existing accessories attachment designs. For instance, under the various proposed schemes in accordance with the present disclosure, a new locking mechanism utilizing a combination of the benefits of the Picatinny design and the M-LOK design may be utilized. The new locking mechanism may provide the strength of the Picatinny design while allowing users the flexibility in choosing and using either M-LOK or Picatinny rail accessories.

In one aspect, an apparatus implementable on a firearm may include an accessories attachment device configured to attach to the firearm. The accessories attachment device may include physical features configured to accommodate mounting of accessories capable of mounting by a first design and a second design different than the first design onto the accessories attachment device.

In another aspect, an apparatus implementable on a firearm may include an accessories attachment device configured to attach to the firearm. The accessories attachment device may include a base structure configured to attach to the firearm and accommodate mounting of one or more accessories capable of mounting by a second design. The accessories attachment device may also include a conversion structure configured to assembled on the base structure and accommodate mounting of one or more accessories capable of mounting by a first design different than the second design.

BRIEF DESCRIPTION OF THE DRAWINGS

The accompanying drawings are included to provide a further understanding of the disclosure and are incorporated in and constitute a part of the present disclosure. The drawings illustrate implementations of the disclosure and, together with the description, explain the principles of the disclosure. It is appreciable that the drawings are not necessarily in scale as some components may be shown to be out of proportion than the size in actual implementation to clearly illustrate the concept of the present disclosure.

DETAILED DESCRIPTION OF PREFERRED IMPLEMENTATIONS

Figure 1:
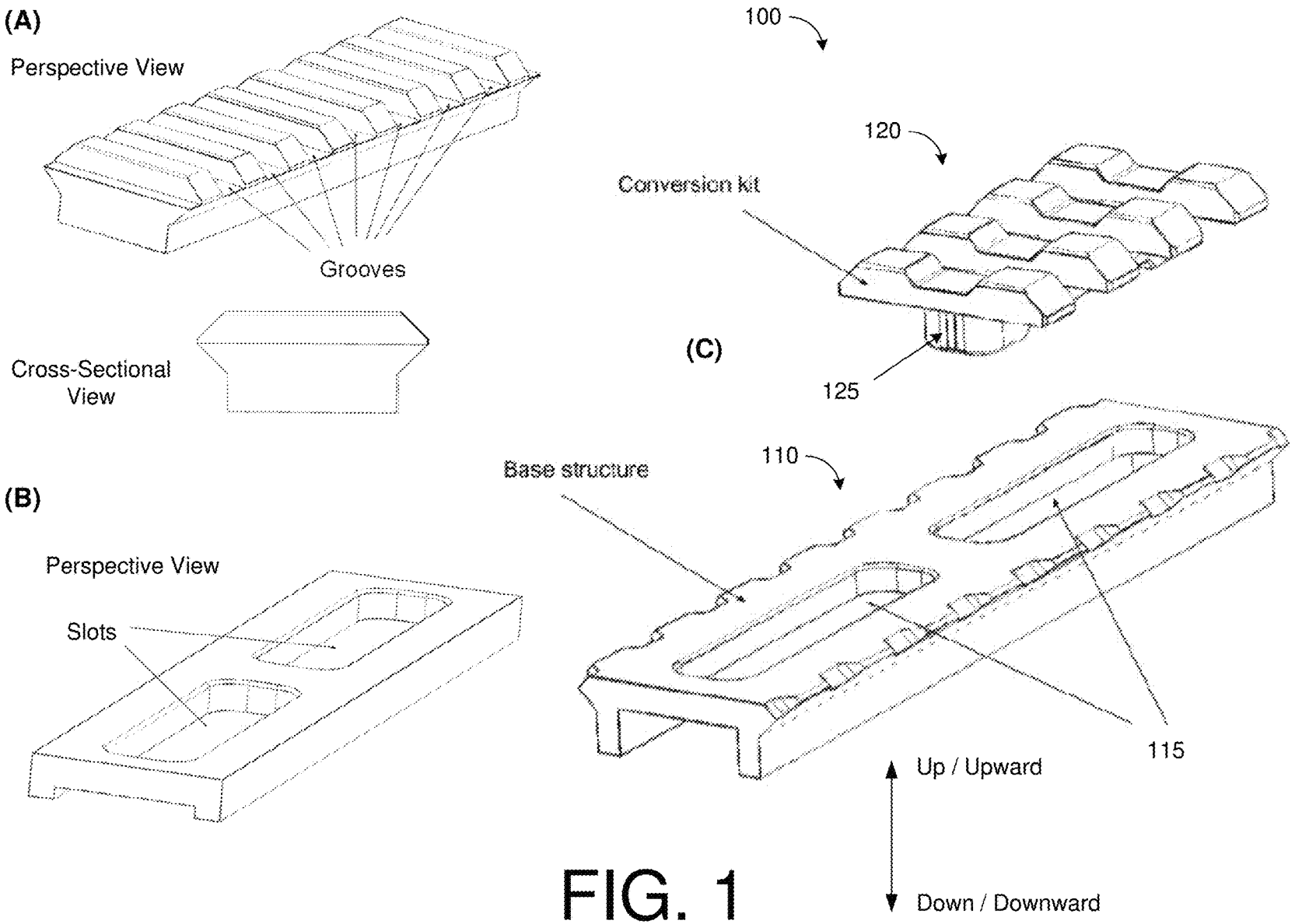
FIG. 1 is a diagram of an example device under a proposed scheme in accordance with an implementation of the present disclosure.

Detailed embodiments and implementations of the claimed subject matters are disclosed herein. However, it shall be understood that the disclosed embodiments and implementations are merely illustrative of the claimed subject matters which may be embodied in various forms. The present disclosure may, however, be embodied in many different forms and should not be construed as limited to the exemplary embodiments and implementations set forth herein. Rather, these exemplary embodiments and implementations are provided so that description of the present disclosure is thorough and complete and will fully convey the scope of the present disclosure to those skilled in the art. In the description below, details of well-known features and techniques may be omitted to avoid unnecessarily obscuring the presented embodiments and implementations.

The position terms used in the present disclosure, such as "front", "forward", "rear", "back", "top", "bottom", "left", "right", "head", "tail" or the like assume a firearm in the normal firing position, with the firearm being in a position in which the longitudinal axis of the barrel of the firearm runs generally horizontally and the direction of firing points "forward" away from the operator or user of the firearm. The same convention applies for the direction statements used herein.

As used herein, the terms "proximal" and "proximally" may denote "forward" and "forwardly" with respect to the firearm, and the terms "distal" and "distally" may denote "rearward" and "rearwardly" with respect to the firearm. As used herein, the verb "to comprise" in this description, claims, and other conjugations are used in its non-limiting sense to mean those items following the word are included, but items not specifically mentioned are not excluded. As used herein, the word "forward" means moving in the direction that the projectile moves during firing a firearm. As used herein, the word "proximal" means closer to the reference point, in this case, the shooter. As used herein, the word "distal" means farther to the reference point, in this case, the shooter. Reference to an element by the indefinite article "a" or "an" does not exclude the possibility that more than one of the elements are present, unless the context clearly requires that there is one and only one of the elements. The indefinite article "a" or "an" thus usually means "at least one." Additionally, the words "a" and "an" when used in the present document in concert with the words "comprising" or "containing" denote "one or more.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure. The recitation of numerical ranges by endpoints includes all numbers within that range (e.g., 1 to 5 includes 1, 1.5, 2, 2.75, 3, 3.80, 4, and 5). All dimensions given herein are by way of examples to better illustrate the present disclosure embodiments and shall not be construed to limit the dimensions of the present disclosure embodiments to the given numeric values.

Overview

Under the various proposed schemes in accordance with the present disclosure, a firearm accessories attachment may include a new locking mechanism utilizing a combination of the benefits of the Picatinny design and the M-LOK design. The new locking mechanism may provide the strength of the Picatinny design while allowing users the flexibility in choosing and using either M-LOK-based or Picatinny-based accessories. When in use, the accessories attachment under the proposed schemes may be mounted on or otherwise attached to a firearm (e.g., an AR-15 or AR-10 style rifle, carbine, shotgun or pistol).

FIG. 1 illustrates an example device 100 under a proposed scheme in accordance with the present disclosure. Part (A) of FIG. 1 shows a perspective view and a cross-sectional view of an accessories attachment under the Picatinny design, which has a plurality of grooves for mounting of accessories. Part (B) of FIG. 1 shows a perspective view of an accessories attachment under the M-LOK design, which has slots for attachment of accessories. Part (C) of FIG. 1 shows example device 100 under the proposed scheme, which includes a base structure 110 and a conversion structure 120. The base structure 110 may have one or more slots 115 and may be configured to be attached by M-LOK or other similar accessories (e.g., those accessories designed to be mounted on or otherwise attached to an M-LOK-based accessories attachment or rail or a KeyMod-based accessories attachment or rail). The conversion structure 120 may be configured to insert into and accommodated by at least one of the one or more slots 115 of the base structure 110. When combined, the assembly of base structure 110 and conversion structure 120 may be attached by Picatinny accessories (e.g., those accessories designed to be mounted on or otherwise attached to a Picatinny-based accessories attachment or rail). The conversion structure 120 may have an accessories attachment side (e.g., the side that faces upward in FIG. 1) and an assembly side (e.g., the side that faces downward in FIG. 1) opposite the accessories attachment side. As shown in FIG. 1, conversion structure 120 may be configured with a protrusion 125 extending outwardly on the assembly side, which may be utilized to mount conversion structure 120 onto base structure 110 (e.g., by inserting the protrusion 125 of conversion structure 120 into one of the slots 115 of base structure 110).

Figure 2:
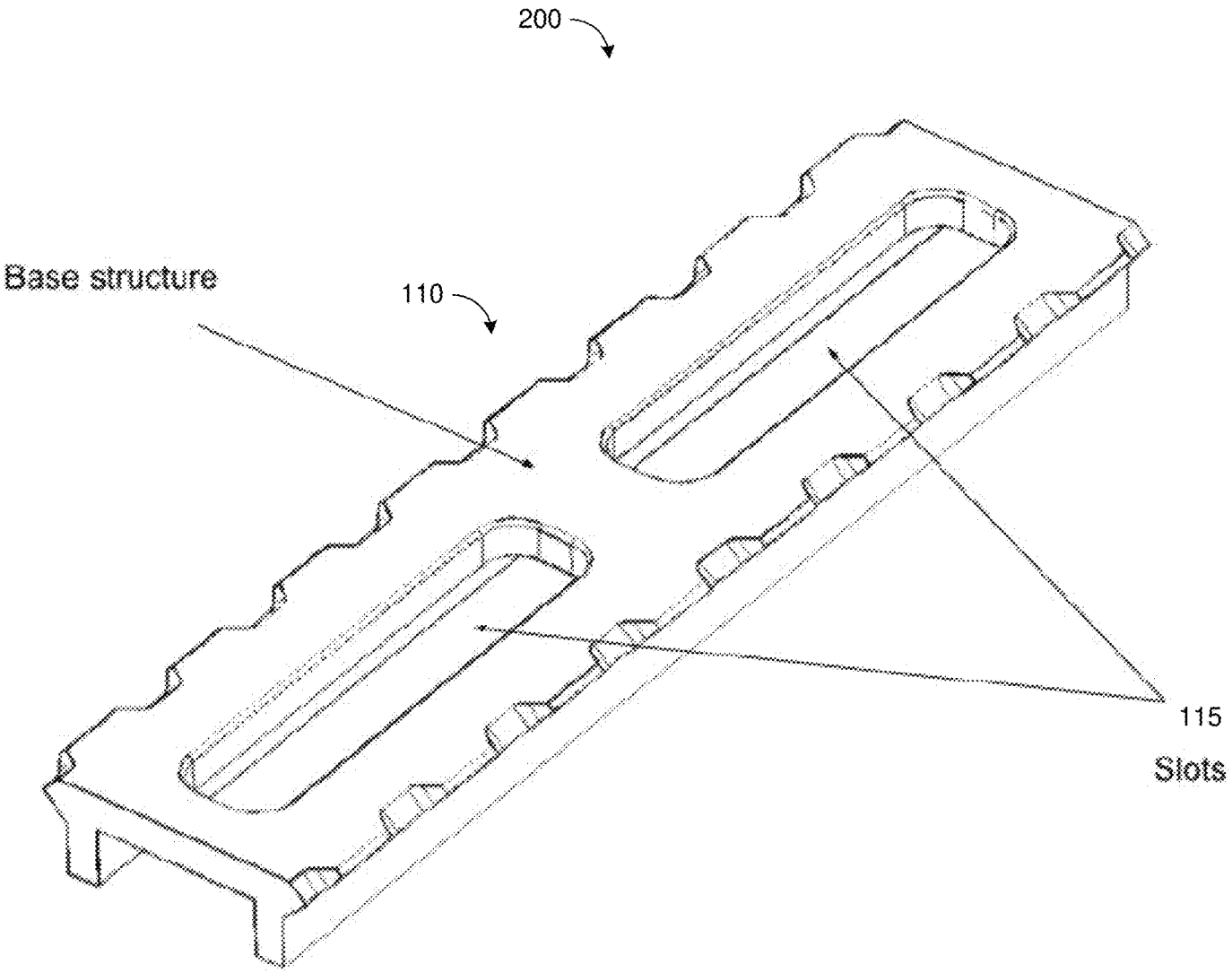
FIG. 2 is a diagram of an example design under a proposed scheme in accordance with an implementation of the present disclosure.

FIG. 2 illustrates an example design 200 under a proposed scheme in accordance with the present disclosure. Design 200 may pertain to a design of base structure 110. As shown in FIG. 2, base structure 110 may include one or more slots 115. Additionally, base structure 110 may have a mating side (e.g., the side that faces upward in FIG. 2) and a mounting side. The mating side may be configured to mate, receive or otherwise accommodate the conversion structure 120 (e.g., the assembly side thereof).

The mounting side may be configured to attach to or otherwise mount on a portion of a firearm (e.g., a handguard, upper receiver or lower receiver of an AR-15 or AR-10 style firearm). The slots 115 may be designed with dimensions similar to those of the slots of the M-LOK design, thereby allowing those accessories designed to be mounted on or otherwise attached to an M-LOK-based accessories attachment or rail to be mounted on or otherwise attached to the mating side of base structure 110 (e.g., by being inserted into one or more of slots 115).

Figure 3:
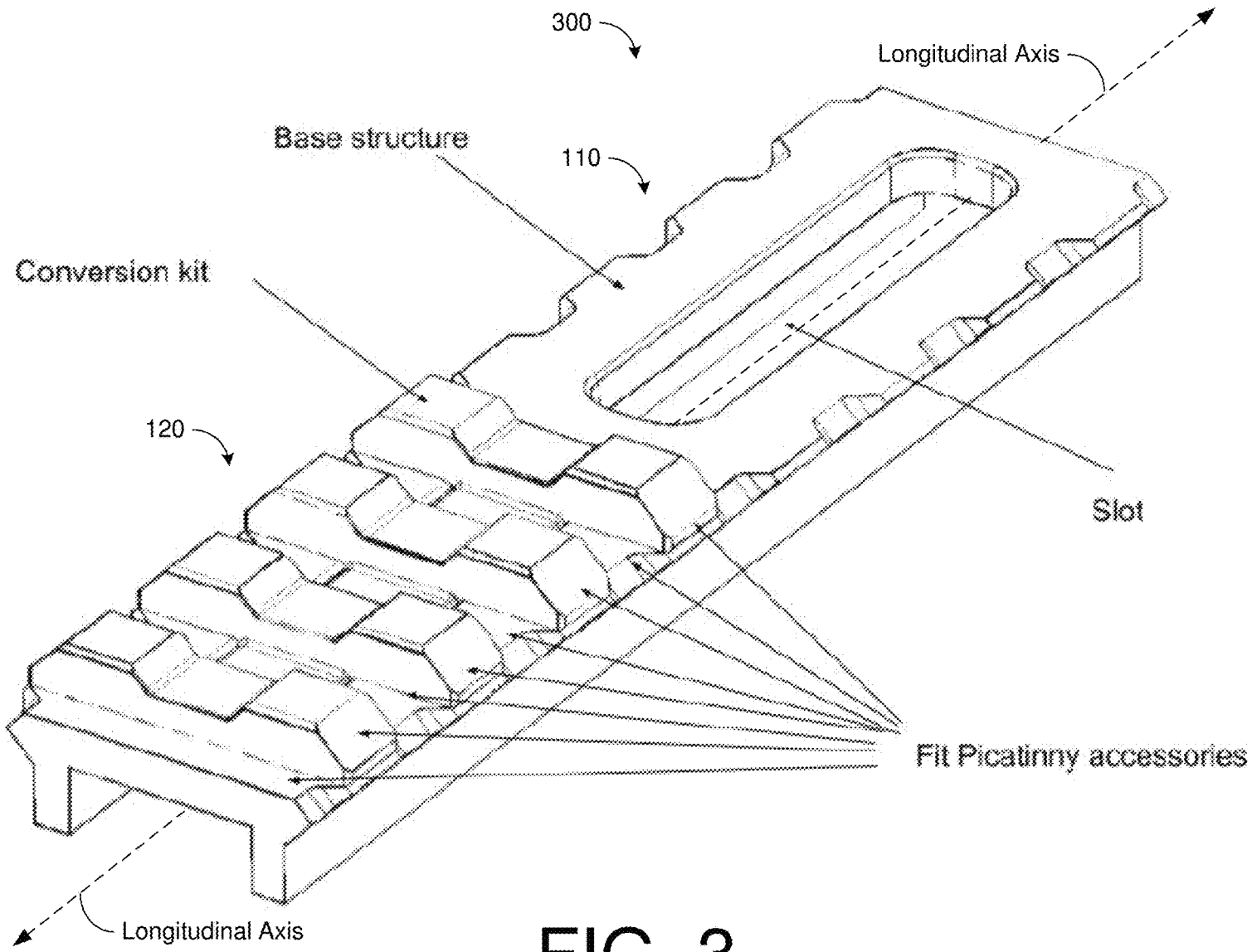
FIG. 3 is a diagram of an example design under a proposed scheme in accordance with an implementation of the present disclosure.

FIG. 3 illustrates an example design 300 under a proposed scheme in accordance with the present disclosure. Design 300 may pertain to a design of a device comprising an assembly of base structure 110 and conversion structure 120. The conversion structure 120 may have the same length or a different length (e.g., shorter) than the length of base structure 110. In the example shown in FIG. 3, conversion structure 120 has a length shorter than that of base structure 110, and conversion structure 120 is mounted on base structure 110 with protrusion 125 of conversion structure 120 inserted into one of the two slots 115 of base structure 110.

Figure 4:
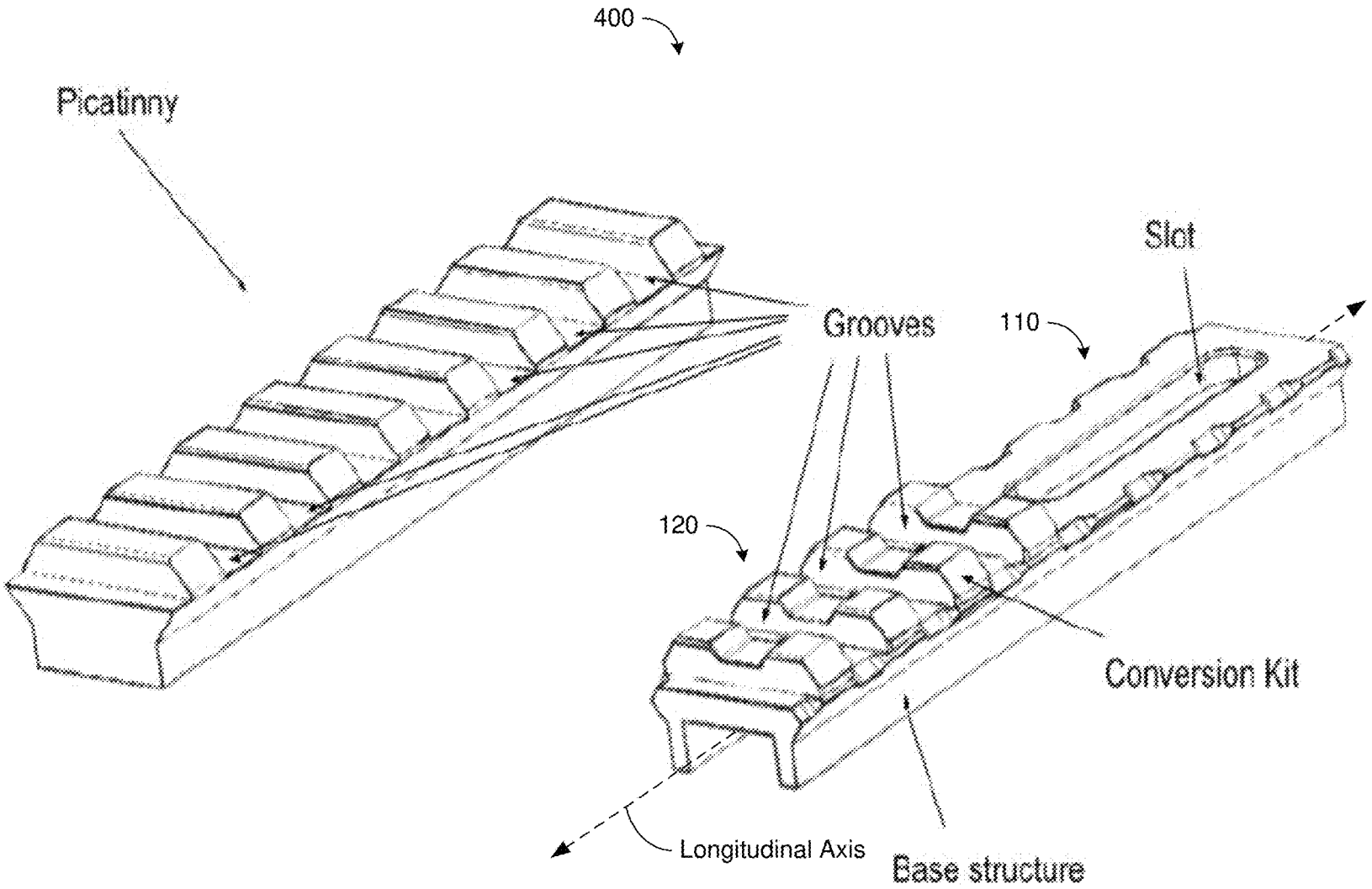
FIG. 4 is a diagram of an example design under a proposed scheme in accordance with an implementation of the present disclosure.

FIG. 4 illustrates an example design 400 under a proposed scheme in accordance with the present disclosure. Design 400 may pertain to a design of a device comprising an assembly of base structure 110 and conversion structure 120. As shown in FIG. 4, the assembly of base structure 110 and conversion structure 120 may have physical features (e.g., grooves) with dimensions similar to those of the grooves of the Picatinny design, thereby allowing those accessories designed to be mounted on or otherwise attached to a Picatinny-based accessories attachment or rail to be mounted on or otherwise attached to the accessories attachment side (e.g., the side that faces upward in FIG. 3) of conversion structure 120. Referring to FIG. 4, the grooves of conversion structure 120 that have troughs and ridges with dimensions similar to the grooves of the Picatinny design may be diagonal or perpendicular to a longitudinal axis of the assembly. In some implementations, conversion structure 120 may be additionally configured with a longitudinal groove that is parallel to the longitudinal axis of the assembly.

Figure 5:
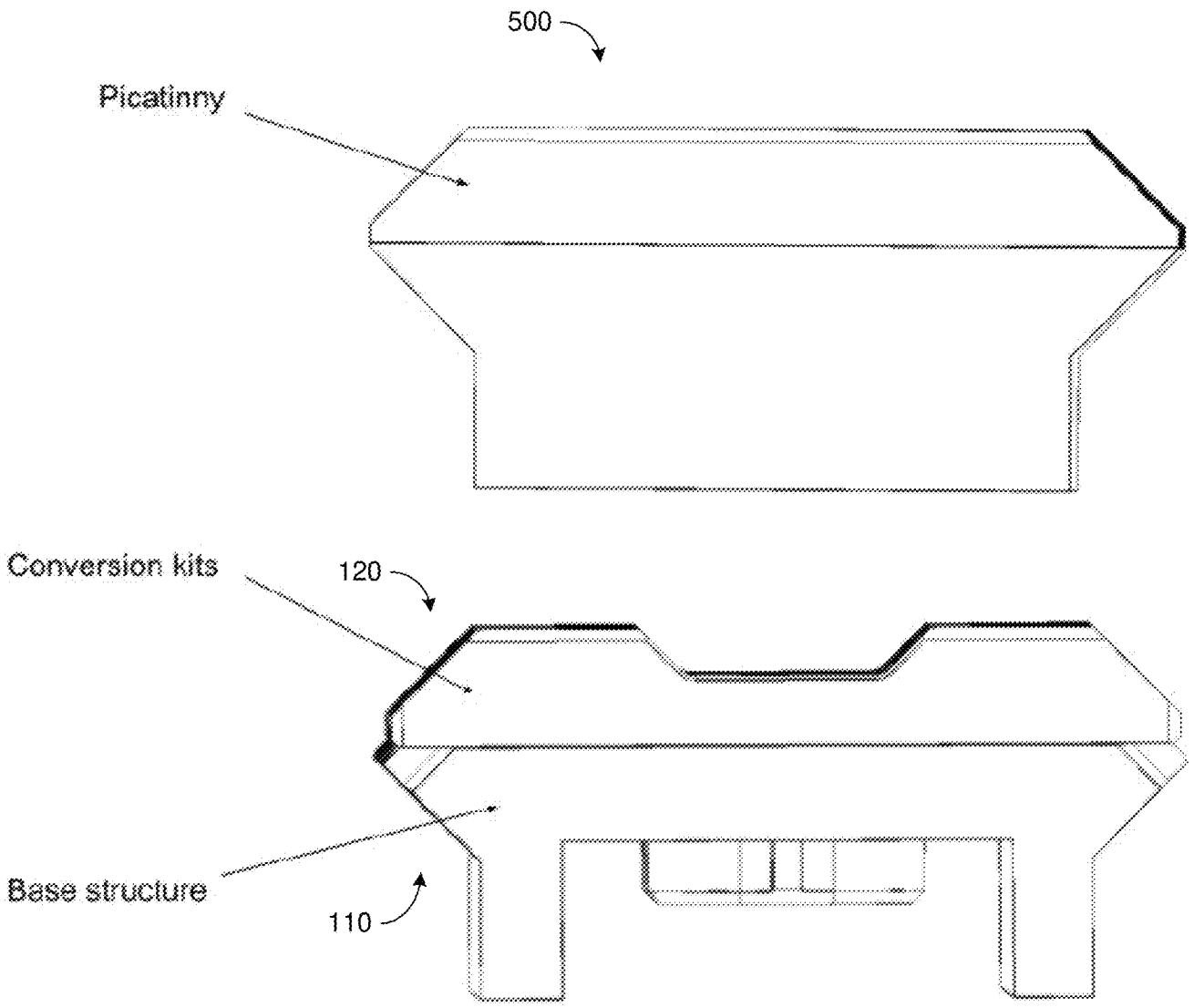
FIG. 5 is a diagram of an example design under a proposed scheme in accordance with an implementation of the present disclosure.

FIG. 5 illustrates an example design 500 under a proposed scheme in accordance with the present disclosure. Design 500 may pertain to a design of a device comprising an assembly of base structure 110 and conversion structure 120. As shown in FIG. 5, the assembly of base structure 110 and conversion structure 120 (e.g., device 100) may have a cross-sectional profile (cutting across a longitudinal axis of the assembly which is shown in FIG. 3 and FIG. 4) identical or similar to that of a Picatinny accessories attachment or rail. Thus, a portion (e.g., a first half) of the assembly of base structure 110 and conversion structure 120 may allow those accessories designed to be mounted on or otherwise attached to a Picatinny-based accessories attachment or rail to be mounted on or otherwise attached to the accessories attachment side (e.g., the side that faces upward in FIG. 5) of conversion structure 120. Moreover, another portion (e.g., a second half) of the assembly of base structure 110 and conversion structure 120 may allow those accessories designed to be mounted on or otherwise attached to an M-LOK-based accessories attachment or rail to be mounted on or otherwise attached to one of the one or more slots 115 of base structure 110. In other words, the assembly of base structure 110 and conversion structure 120 may allow a user the flexibility to mount or otherwise attach either or both of a Picatinny-based accessory and an M-LOK-based accessory to the firearm on which the assembly of base structure 110 and conversion structure 120 (e.g., device 100) is mounted.

Example Implementations

In view of the above, the proposed designs of a reflex sight may be implemented in many ways. For illustrative purposes and without limiting the scope of the present disclosure, a few example implementations of the proposed design are described below.

In one aspect, an apparatus implementable on a firearm (e.g., an AR-15 or AR-10 style firearm) may include an accessories attachment device. The accessories attachment device may be configured to attach to the firearm, and the accessories attachment device may include physical features configured to accommodate mounting of accessories capable of mounting by a first design and a second design different than the first design onto the accessories attachment device.

In some implementations, mounting of a first accessory capable of mounting by the first design may involve one or more grooves of the accessories attachment device. Moreover, mounting of a second accessory capable of mounting by the second design may involve a slot of the accessories attachment device.

In some implementations, the first design may include a Picatinny-based design, and the second design may include an M-LOK-based design.

In some implementations, the accessories attachment device may include a base structure and a conversion structure. The base structure may be configured to attach to the firearm and accommodate mounting of one or more accessories capable of mounting by the second design. The conversion structure may be configured to assembled on the base structure and accommodate mounting of one or more accessories capable of mounting by the first design.

In some implementations, when the conversion structure is assembled on the base structure, a portion of the base structure may be exposed such that the accessories attachment device allows simultaneous mounting of a first accessory capable of mounting by the first design and a second accessory capable of mounting by the second design onto the accessories attachment device.

In some implementations, the first design may include a Picatinny-based design. Moreover, the second design may include an M-LOK-based design.

In some implementations, the base structure may be configured with one or more slots each configured to accommodate a respective accessory capable of mounting by the M-LOK-based design. Furthermore, the conversion structure may be configured with grooves configured to accommodate at least one accessory capable of mounting by the Picatinny-based design.

In some implementations, the conversion structure may have an accessories attachment side with the grooves and an assembly side opposite the accessories attachment side. In some implementations, the assembly side may be configured with a protrusion insertable into one of the one or more slots of the base structure.

In some implementations, when the conversion structure is assembled on the base structure, a cross-sectional profile of the accessories attachment device may resemble a cross-sectional profile of a Picatinny rail.

In one aspect, an apparatus implementable on a firearm (e.g., an AR-15 or AR-10 style firearm) may include an accessories attachment device. The accessories attachment device may be configured to attach to the firearm. The accessories attachment device may include a base structure and a conversion structure. The base structure may be configured to attach to the firearm and accommodate mounting of one or more accessories capable of mounting by a second design. The conversion structure may be configured to assembled on the base structure and accommodate mounting of one or more accessories capable of mounting by a first design different than the second design.

In some implementations, when the conversion structure is assembled on the base structure, a portion of the base structure may be exposed such that the accessories attachment device allows simultaneous mounting of a first accessory capable of mounting by the first design and a second accessory capable of mounting by the second design onto the accessories attachment device.

In some implementations, the first design may include a Picatinny-based design. Moreover, the second design may include an M-LOK-based design.

In some implementations, the base structure may be configured with one or more slots each configured to accommodate a respective accessory capable of mounting by the M-LOK-based design. Moreover, the conversion structure may be configured with grooves configured to accommodate at least one accessory capable of mounting by the Picatinny-based design.

In some implementations, the conversion structure may have an accessories attachment side with the grooves and an assembly side opposite the accessories attachment side. Additionally, the assembly side may be configured with a protrusion insertable into one of the one or more slots of the base structure.

In some implementations, when the conversion structure is assembled on the base structure, a cross-sectional profile of the accessories attachment device may resemble a cross-sectional profile of a Picatinny rail.

Additional Notes

The herein-described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Further, with respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Moreover, it will be understood by those skilled in the art that, in general, terms used herein, and especially in the appended claims, e.g., bodies of the appended claims, are generally intended as "open" terms, e.g., the term "including" should be interpreted as "including but not limited to," the term "having" should be interpreted as "having at least," the term "includes" should be interpreted as "includes but is not limited to," etc. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to implementations containing only one such recitation, even when the same claim includes the introductory phrases "one or more" or "at least one" and indefinite articles such as "a" or "an," e.g., "a" and/or "an" should be interpreted to mean "at least one" or "one or more;" the same holds true for the use of definite articles used to introduce claim recitations. In addition, even if a specific number of an introduced claim recitation is explicitly recited, those skilled in the art will recognize that such recitation should be interpreted to mean at least the recited number, e.g., the bare recitation of "two recitations," without other modifiers, means at least two recitations, or two or more recitations. Furthermore, in those instances where a convention analogous to "at least one of A, B, and C, etc." is used, in general such a construction is intended in the sense one having skill in the art would understand the convention, e.g., "a system having at least one of A, B, and C" would include but not be limited to systems that have A alone, B alone, C alone, A and B together, A and C together, B and C together, and/or A, B, and C together, etc. In those instances where a convention analogous to "at least one of A, B, or C, etc." is used, in general such a construction is intended in the sense one having skill in the art would understand the convention, e.g., "a system having at least one of A, B, or C" would include but not be limited to systems that have A alone, B alone, C alone, A and B together, A and C together, B and C together, and/or A, B, and C together, etc. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various implementations of the present disclosure have been described herein for purposes of illustration, and that various modifications may be made without departing from the scope and spirit of the present disclosure. Accordingly, the various implementations disclosed herein are not intended to be limiting, with the true scope and spirit being indicated by the following claims.

What is claimed is:

1. An apparatus implementable on a firearm, comprising:

an accessories attachment device configured to attach to a portion of the firearm, the accessories attachment device comprises physical features configured to accommodate mounting of accessories capable of mounting by a first design and a second design different than the first design onto the accessories attachment device, wherein the accessories attachment device comprises:

a base structure configured with one or more slots, a first side, which is configured to attach to the portion of the firearm, and a second side, which is opposite the first side and configured with a flat surface to accommodate mounting of one or more accessories capable of mounting by the second design; and a conversion structure with a first side configured to mate with the flat surface of the second side of the base structure when the conversion structure is assembled on the base structure, the first side of the conversion structure having a protrusion configured to be inserted into one of the one or more slots of the base structure when the conversion structure is assembled on the base structure, a second side of the conversion structure opposite the first side thereof configured to accommodate mounting of one or more accessories capable of mounting by the first design, wherein, when attached to the portion of the firearm which is configured for mounting by the first design, the accessories attachment device enables the portion of the firearm to allow attachment of one or more accessories, each configured to be mounted by the second design, to the portion of the firearm without any fastener.

2. The apparatus of claim 1, wherein mounting of a first accessory capable of mounting by the first design involves one or more grooves of the accessories attachment device, and wherein mounting of a second accessory capable of mounting by the second design involves a slot of the accessories attachment device.

3. The apparatus of claim 1, wherein the accessories attachment device comprises:

a base structure configured to attach to the firearm and accommodate mounting of one or more accessories capable of mounting by the second design; and a conversion structure configured to be assembled on the base structure and accommodate mounting of one or more accessories capable of mounting by the first design.

4. The apparatus of claim 1, wherein, when the conversion structure is assembled on the base structure, a portion of the flat surface and one of the one or more slots on the base structure is are exposed such that the accessories attachment device allows simultaneous mounting of a first accessory capable of mounting by the first design and a second accessory capable of mounting by the second design onto the accessories attachment device.

5. The apparatus of claim 1, wherein:

the base structure is configured with one or more slots each configured to accommodate a respective accessory capable of mounting by the first design; and the conversion structure is configured with grooves configured to accommodate at least one accessory capable of mounting by the second design.

6. The apparatus of claim 5, wherein the conversion structure has an accessories attachment side with the grooves and an assembly side opposite the accessories attachment side, and wherein the assembly side is configured with a protrusion insertable into one of the one or more slots of the base structure.

7. The apparatus of claim 1, wherein, when the conversion structure is assembled on the base structure, a cross-sectional profile of the accessories attachment device resembles a cross-sectional profile of a rail of the second design.

8. An apparatus implementable on a firearm, comprising:

an accessories attachment device configured to attach to a portion of the firearm, the accessories attachment device comprising:

a base structure configured with one or more slots, a first side, which is configured to attach to the portion of the firearm, and a second side, which is opposite the first side and configured with a flat surface to accommodate mounting of one or more accessories capable of mounting by the second design; and a conversion structure with a first side configured to mate with the flat surface of the second side of the base structure when the conversion structure is assembled on the base structure, the first side of the conversion structure having a protrusion configured to be inserted into one of the one or more slots of the base structure when the conversion structure is assembled on the base structure, a second side of the conversion structure opposite the first side thereof configured to accommodate mounting of one or more accessories capable of mounting by the first design.

9. The apparatus of claim 8, wherein, when the conversion structure is assembled on the base structure, a portion of the flat surface and one of the one or more slots on the base structure are exposed such that the accessories attachment device allows simultaneous mounting of a first accessory capable of mounting by the first design and a second accessory capable of mounting by the second design onto the accessories attachment device.

10. The apparatus of claim 8, wherein:

each of the one or more slots on the base structure is configured to accommodate a respective accessory capable of mounting by the first design; and the conversion structure is configured with grooves configured to accommodate at least one accessory capable of mounting by the second design.

11. The apparatus of claim 10, wherein the conversion structure has an accessories attachment side with the grooves and an assembly side opposite the accessories attachment side, and wherein the assembly side is configured with a protrusion insertable into one of the one or more slots of the base structure.

12. The apparatus of claim 8, wherein, when the conversion structure is assembled on the base structure, a cross-sectional profile of the accessories attachment device resembles a cross-sectional profile of a rail of the second design.

* * * * *